US006062794A

United States Patent [19]

Shiba

[11] Patent Number: 6,062,794

[45] Date of Patent: May 16, 2000

[54] PAPER ROLL STORAGE AND PAPER ROLL SUPPLY SYSTEM

[75] Inventor: Noriyuki Shiba, Tokyo, Japan

[73] Assignee: Kabushiki Kaisha Tokyo Kikai Seisakusho, Tokyo, Japan

[21] Appl. No.: 09/275,772

[22] Filed: Mar. 25, 1999

Related U.S. Application Data

[63] Continuation of application No. 08/054,013, Apr. 29, 1993, abandoned.

[30] Foreign Application Priority Data

May 15, 1992 [JP] Japan ..... 4-12360

[51] Int. Cl.[7] ..... B65G 1/06

[52] U.S. Cl. ..... 414/282; 242/559.3; 242/559.4; 414/276; 414/277; 414/911

[58] Field of Search ..... 242/559.3, 559.4, 242/282; 414/911, 276, 277, 279, 281, 807

[56] References Cited

U.S. PATENT DOCUMENTS

| | | | |
|---|---|---|---|
| 4,708,300 | 11/1987 | Goetz | 242/559.3 |
| 4,863,335 | 9/1989 | Herigstad et al. | 414/911 |
| 5,076,751 | 12/1991 | Kafka | 414/911 |
| 5,085,377 | 2/1992 | Rohrer et al. | 414/911 |
| 5,096,355 | 3/1992 | Schroder | 414/911 |
| 5,238,352 | 8/1993 | Abe et al. | 414/911 |

FOREIGN PATENT DOCUMENTS

| | | |
|---|---|---|
| 59-48347 | 3/1984 | Japan . |
| 61-23006 | 1/1986 | Japan . |
| 62-74859 | 4/1987 | Japan . |
| 1-299148 | 12/1989 | Japan . |

OTHER PUBLICATIONS

Recent Newspaper Production Major Equipments—1986, issued by Japanese Newspaper Association.

*Primary Examiner*—Thomas J. Brahan
*Attorney, Agent, or Firm*—Ronald P. Kananen; Rader, Fishman & Grauer

[57] ABSTRACT

A paper roll supply system for a printing press system comprises a paper roll storage portion having a plurality of vertically arranged shelves for storing a plurality of paper rolls in desired orientation and a paper roll delivery outlet for the paper roll storage portion, the paper roll delivery outlet being positioned in alignment with a paper roll supply station along a substantially straight paper roll transporting path, by way of which a paper roll is transferred to a printing press. For supplying the paper roll to the printing press system, a paper roll transporting means is disposed between the paper roll delivery outlet and the paper roll supply station for transporting a paper roll along the paper roll transporting path.

15 Claims, 2 Drawing Sheets

PAPER ROLL STORAGE AND PAPER ROLL SUPPLY SYSTEM

This application is a continuation of application Ser. No. 08/054,013 filed Apr. 29, 1993, now abandoned.

BACKGROUND OF THE INVENTION

1. Field of the Invention

The present invention relates generally to a paper roll storage and paper roll supply system for supplying paper roll to a paper feeder station of a rotary press from the paper roll storage. More specifically, the invention relates to a paper roll storage and a paper roll supply system, which improves the efficiency with which paper rolls can be stocked.

2. Description of the Related Art

In a printing factory, it is required to stock a large amount of paper rolls to ensure uninterrupted production of a large amount of printed material by means of rotary presses. Therefore, a paper roll storage is essential.

Typical examples of such paper roll storage arrangements are disclosed in Japanese Unexamined Patent Publication No. 59-48347, particularly in FIG. 3, Japanese Unexamined Patent Publication No. 62-74859, particularly in FIG. 5, Japanese Unexamined Patent Publication No. 1299148, particularly in FIG. 1, and "Recent Newspaper Production Major Equipments 1986", May 17, 1986, issued by Japanese Newspaper Association, particularly in FIG. 5 and on page 382 and pages 378 to 383. In this disclosed prior art, a plurality of paper rolls are arranged on a common floor and oriented for stocking. As discussed on pages 376 and 377 of the latter mentioned publication, there has been employed, in recent years, paper roll storage of a spacial storage form for storing a plurality of paper rolls on a plurality of spatially arranged storage areas.

Furthermore, as shown in FIG. 2, one or more paper roll delivery outlets 21*a* for delivering paper rolls 29 to respective feeder stations 22 of respective rotary presses are provided at one portion or concentrically at another, in a paper roll storage 21. A paper roll transporting system 24 is provided for transporting the paper roll supplied from the paper roll delivery outlet 218 to paper roll supply station 23 of feeder stations 22. The paper roll transporting system 24 includes a paper roll transporting path 24*a* extending across respective paper roll supply stations 23 of the feeder stations 22 and transporting carriers 24*b*, which is driven by an appropriate drive means (not shown). The paper roll 29 is transported to the paper roll supply station 23 by the paper roll transporting system 24 and supplied to the feeder station 22 with the aid of a traverser 23*a*.

However, this type of prior art encounters the following problems. Namely, in case of the paper roll storage which stocks paper rolls on a common floor, a relatively wide floor area has been required. This clearly increases the floor area of the paper roll storage in a building and wastes a large amount of space.

Also, in the paper roll storage wherein paper rolls are stacked on a common floor or in the spacial type of storage arrangement, since one paper roll delivery outlet or a plurality of paper roll delivery outlets are concentrically located at one location, and the paper roll transporting system which includes a paper roll transporting path extending across the paper roll supply stations of respective feeder portions, the paper roll transporting system naturally becomes large and complicated with the attendant high cost and possibility of failure.

SUMMARY OF THE INVENTION

In view of the drawbacks in the prior art set forth above, it is an object of the present invention to provide a paper roll storage and a paper roll supply system, which can reduce the amount of floor space required for the paper roll storage in a building, reduce the scale of a paper roll transporting system, simplify construction, reduce the cost of the facility and reduce the possibility of failure.

According to one aspect of the invention, a spacial paper roll storage comprises:

a paper roll storage portion having a plurality of vertically arranged shelves for storing a plurality of paper rolls in a desired orientation; and a paper roll delivery outlet of the paper roll storage portion, the paper roll delivery outlet being positioned in alignment with a paper roll supply station and in a direction of a substantially straight paper roll transporting path, along which a paper roll is transferred to a printing press.

According to another aspect of the invention, a paper roll supply system for a printing press system comprises:

a paper roll storage portion having a plurality of vertically arranged shelves for storing a plurality of paper rolls in a desired orientation;

a paper roll delivery outlet of the paper roll storage portion, the paper roll delivery outlet being positioned so as to be aligned with a paper roll supply station along a substantially straight paper roll transporting path, by way of which a paper roll is transferred to a printing press; and a paper roll transporting means disposed between the paper roll delivery outlet and the paper roll supply station for transporting a paper roll along the paper roll transporting path.

In either case, a plurality of the paper roll delivery outlets are provided in the spacial paper roll storage in spaced apart relationship to each other, each of the paper roll delivery outlets being positioned in alignment with corresponding one of paper roll supply stations in a direction of a substantially straight paper roll transporting paths, and a plurality of the paper roll transporting means are provided between respective paper roll delivery outlets and the paper roll supply stations along the paper roll transporting paths. In these cases set forth above, a plurality of the paper roll delivery outlets are provided in the spacial paper roll storage in spaced apart relationship to each other, and each of the paper roll delivery outlets is positioned in alignment with corresponding one of paper roll supply stations in a direction of a substantially straight paper roll transporting paths.

The paper roll transporting system may includes a orienting means for orienting the paper roll at a desired orientation. Practically, the orienting means comprises a turntable provided in the paper roll transporting path.

In the preferred construction, the paper roll supply system further comprise a transverse path connecting a plurality of the paper roll transporting path for permitting transportation of the paper roll in a direction transverse to the direction of the paper roll transporting path. In this case, each of the paper roll transporting systems includes a orienting means for orienting the paper roll at a desired orientation, the orienting means is positioned at an intersection with the transverse path.

According to a further aspect of the invention, a paper roll supply system for a first and second rotary press systems comprises:

at least one paper roll storage portion having a plurality of vertically arranged shelves for storing a plurality of paper rolls in desired orientation;

a first paper roll delivery outlet of the paper roll storage portion, the first paper roll delivery outlet being positioned in alignment with a first paper roll supply station for supplying paper roll to a feeder portion of the first rotary press, in a direction of a substantially straight first paper roll transporting path, at which a paper roll is transferred to the first rotary press;

a second paper roll delivery outlet of the paper roll storage portion positioned in spaced apart parallel relationship with the first paper roll delivery outlet, the second paper roll delivery outlet being positioned in alignment with a second paper roll supply station positioned in spaced apart parallel relationship with the first paper roll supply station for supplying paper roll to a feeder portion of the second rotary press, in a direction of a substantially straight second paper roll transporting path extending in spaced apart parallel relationship with the first paper roll supply path, at which a paper roll is transferred to the second rotary press;

a first paper roll transporting means disposed between the first paper roll delivery outlet and the first paper roll supply station for transporting a paper roll along the first paper roll transporting path; and a second paper roll transporting means disposed between the second paper roll delivery outlet and the second paper roll supply station for transporting a paper roll along the second paper roll transporting path.

BRIEF DESCRIPTION OF THE DRAWINGS

The present invention will be understood more fully from the detailed description given herebelow and from the accompanying drawings of the preferred embodiment of the invention, which, however, should not be taken to be limitative to the invention, but are for explanation and understanding only.

In the drawings.

DESCRIPTION OF THE PREFERRED EMBODIMENT

Figure 1:
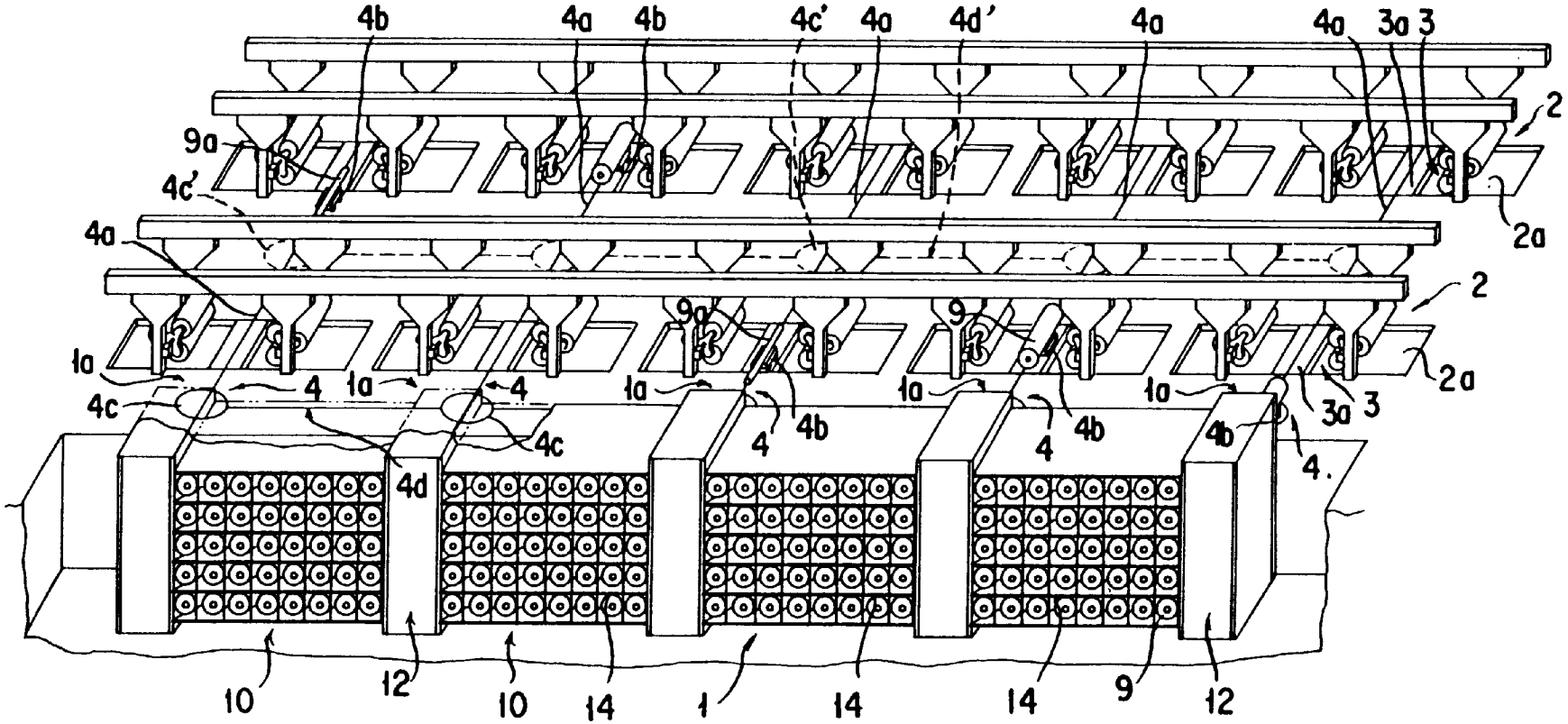
FIG. 1 is a perspective view of the preferred embodiment of a paper roll storage and a paper roll supply system according to the present invention.
Figure 2:
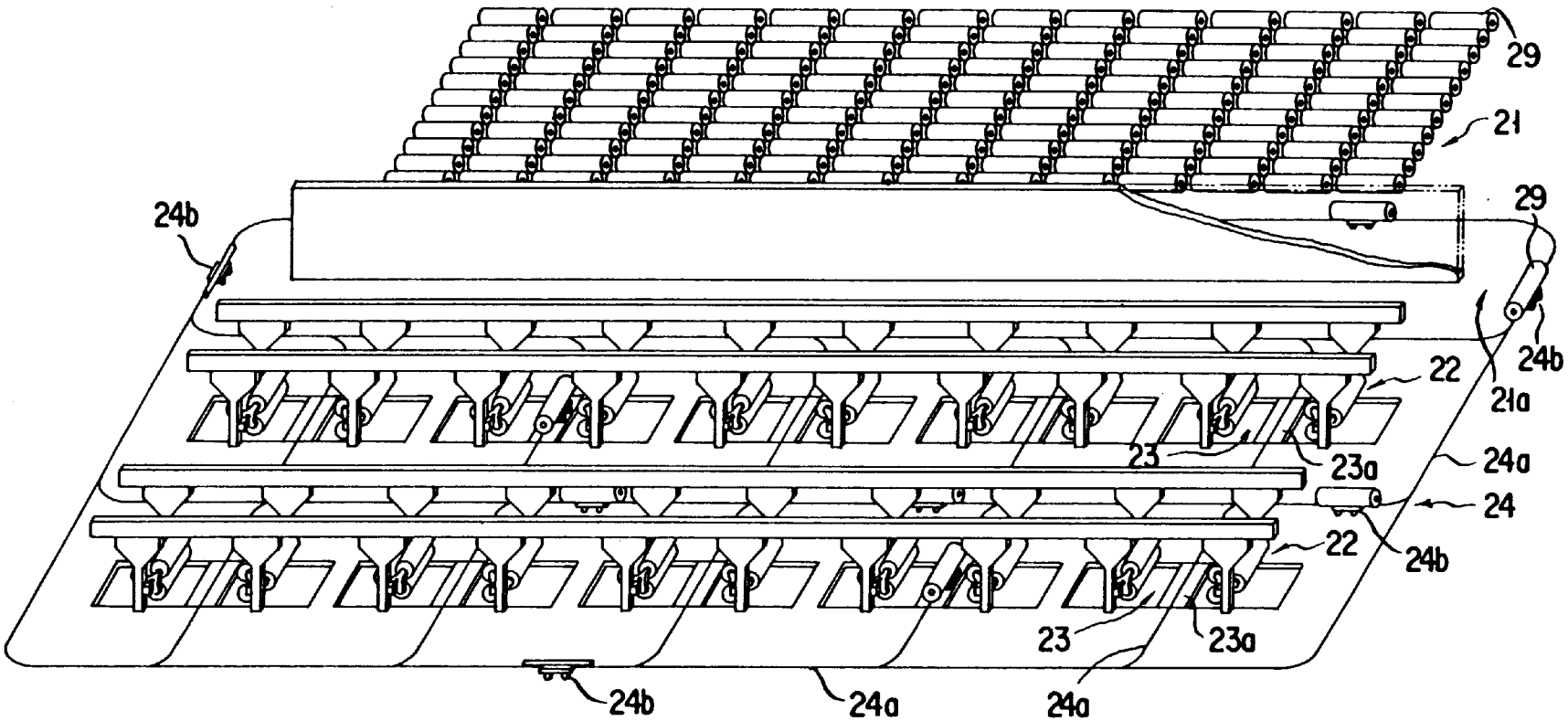
FIG. 2 PRIOR ART
FIG. 2 is a perspective view of the conventional paper roll storage and paper roll supply system.

FIG. 1 shows a preferred embodiment of a paper roll storage 1 in a spacial storage form. This arrangement will be hereinafter referred to as a spacial paper roll storage. The spacial paper roll storage 1 is separated into a plurality of storage portions 10 by paper roll pick-up mechanism 12. Respective storage portions 10 are spatially separated vertically by shelves 14. In the illustrated embodiment, each storage portion 10 is provided with five rows of shelves 14 which each respectively receive eight paper rolls 9. The paper rolls 9 in each shelf 14 may be shifted toward the paper roll pick-up mechanism 12 by an appropriate paper roll shifting means. As the paper roll shifting means various known mechanisms employed in automatic storage technologies can be used. Each paper roll pick-up mechanism 12 has a paper roll delivery outlet 1*a*. The paper roll pick-up mechanism 12 may be constructed in various ways. Any known mechanism for receiving the paper roll from one of the shelves 14 and shifting to the paper roll delivery outlet 1*a* can be employed in the paper roll pick-up mechanism.

At respective positions corresponding to respective paper roll delivery outlets 1*a,* paper roll supply stations 3 are arranged in alignment with paper roll delivery direction. Feeder portions 2 of rotary presses are positioned at both sides of the respective paper roll supply stations 3 for feeding paper rolls to respectively associated rotary presses. Paper roll transporting systems 4 are provided for transporting paper rolls from the paper roll pick-up mechanism 12.

In the illustrated embodiment, ten feeder portions 2 are respectively hung from pairs of stationary beams in a parallel relationship to each other. The paper roll supply stations 3 defined between respective pairs of feeder portions 2 at proximal distant sides are positioned in alignment. The paper roll transporting systems 4 defines paper roll transporting paths 4*a* extending across the aligned paper roll supply stations 3. Carriers 4*b* of the paper roll transporting systems 4 are adapted to travel from the corresponding paper roll delivery outlets 1*a* to the desired paper roll supply station 3.

Pits 2*a* are formed on the floor at respective paper roll supply stations 3. Transverses 3*a* are received within the pits 2*a* for movement in a direction transverse to the traveling direction of the carriers 4*b*. The transverse 3*a* operates in per se known manner for transversely shifting the carrier 4*b* carrying the paper roll 9 to one of the feeder portion 2 at one side of the paper roll supply station 3.

In addition, the paper roll transporting systems 4 are provided with turntables 4*c* for changing the orientation of the paper roll 9 and the carrier 4*b*.

With the illustrated construction, this embodiment of the spacial paper roll storage 1 of present invention can stock an increased number of paper rolls 9 in a three dimensional arrangement.

At respective paper roll pick-up mechanism 12, selected one of paper rolls 9 in the corresponding paper roll storage portion 10 is picked up by the paper roll pickup mechanism 12 and transferred to the carrier 4*b* at the paper roll delivery outlet 1*a* ready for delivery. When supply of the paper roll 9 becomes necessary at one of the feeder portions 2, a paper roll supply demand signal is generated by the relevant feeder portion 2. The paper roll supply demand signal is supplied to the corresponding paper roll transporting system 4. The carrier 4*b* accordingly travels to the paper roll supply station 3, with which the feeder portion 2 demanding paper roll supply is associated, by way of the paper roll transporting path 4*a*.

It should be noted that, upon dispatching the paper roll to the demanding feeder portion 2, it is possible to check the orientation of the paper roll 9. In such case, if the paper roll 9 is not in the required correct orientation, the paper roll 9 with the carrier 4*b* is turned through 180° by the turntable 4*c*.

At the paper roll supply station 3 corresponding to the feeder portion 2 which demands paper roll supply, the carrier 4*b* stops on the transverse 3*a*. Then, the transverse 3*a* with the carrier 4*b* and the paper roll 9 moves toward the corresponding feeder portion 2 for transferring the paper roll 9 from the carrier to the feeder portion. On the other hand, a bear paper roll core 9*a* is transferred from the feeder portion 2 to the carrier 4*b*. Then, the carrier 4*b* returns to the initial position to recover the paper roll core 9*a* and to receive the next paper roll 9.

It should be noted that the construction of the spacial paper roll storage 1 is not restricted to the illustrated construction and can be of any desired constructions. For instance, it is possible to provide respectively independent spacial paper roll storage 1 for each aligned group of feeder portions 2. Also, the number of floors to be formed in the spacial paper roll storage can be of any desired number for obtaining desired capacity of storage. Furthermore, the relationship of positions of the paper roll storage portions 10 and the paper roll delivery outlets 1*a* can be arbitrary determined.

The turntable 4*c* is not restricted to the paper roll transporting path 4*a* and can be installed on the carrier 4*b* so that the orientation of the paper roll 9 can be changed on the carrier. In addition, the paper roll transporting systems 4 may be mutually cooperated to each other through a transverse transporting path 4*d*. In such case, the turntables 4*c* are provided at respective intersections between the transverse transporting path 4*d* and the paper roll transporting paths 4*a*.

With this construction, if the paper roll cannot be supplied from one of the paper roll delivery outlet 1*a* for some reason, such as failure of the paper roll pick-up mechanism 12 or the like, the paper roll 9 may be supplied from other paper roll transporting system 4. This arrangement is also effective when the paper roll supply demand is issued by a proximal side feeder portion 2 while the carrier of the corresponding paper roll transporting system 4 is in service supplying a paper roll to a distant feeder portion 2.

Although the invention has been illustrated and described with respect to a exemplary embodiment thereof, it will be understood by those skilled in the art that various other changes, omissions and additions may be made therein and thereto, without departing from the spirit and scope of the present invention. Therefore, the present invention is not limited to the specific embodiment set out above and includes all possible variants which can be embodied within a scope encompassed by the features set out in the appended claims and the equivalents of those features.

What is claimed is:

1. A paper roll supply system for a rotary press system, comprising:

a plurality of feeder stations for feeding paper rolls to a plurality of rotary presses;

a plurality of paper roll supply stations, each arranged adjacently to at least one of the feeder stations and each supplying paper rolls to at least one of the feeder stations; and a paper roll storage consisting of a single spatial paper roll storage, said spatial paper roll storage comprising:

a plurality of paper roll storage portions having a plurality of vertically arranged shelves for storing a plurality of paper rolls in desired orientation; and a plurality of paper roll pick-up mechanisms associated with said paper roll storage portions in a spaced relationship to each other, each paper roll pick-up mechanism having a respective paper roll delivery outlet positioned in alignment with a corresponding one of said plurality of paper roll supply stations in a direction of a substantially straight paper roll transporting path along which a paper roll is transferred to a rotary press.

2. A paper roll supply system as set forth in claim 1, wherein each of said paper roll supply stations is arranged between a pair of said feeder stations which are adjacently located, each said paper roll supply station supplying paper rolls to both of said adjacently located feeder stations between which the paper roll supply station is arranged.

3. A paper roll supply system for a rotary press system, comprising:

a plurality of feeder stations for feeding paper rolls to a plurality of rotary presses;

a plurality of paper roll supply stations, each of said paper roll supply stations being arranged between a respective pair of adjacent feeder stations, whereby each pair of adjacent feeder stations is exclusively associated with a single paper roll supply station and is exclusively supplied with paper rolls thereby;

a paper roll storage consisting of a single spatial paper roll storage, said spatial paper roll storage comprising:

a plurality of paper roll storage portions having a plurality of shelves spatially arranged on a vertical plane for storing a plurality of paper rolls in desired orientation; and a plurality of paper roll pick-up mechanisms associated with said paper roll storage portions in a spaced relationship to each other, each paper roll pick-up mechanism having a respective paper roll delivery outlet positioned in alignment with a corresponding one of said paper roll supply stations in a direction of a substantially straight paper roll transporting path; and a paper roll transporting means disposed between each paper roll delivery outlet and a corresponding one of said paper roll supply stations for transporting paper rolls along said paper roll transporting path.

4. A paper roll supply system as set form in claim 3, wherein a plurality of said paper roll delivery outlets are provided in a spaced relationship to each other, each of said paper roll delivery outlets being positioned in alignment with a corresponding one of said paper roll supply stations by way of a substantially straight paper roll transporting path, and a plurality of said paper roll transporting means are provided between respective paper roll delivery outlets and said paper roll supply stations along said paper roll transporting paths.

5. A paper roll supply system as set forth in claim 4, further comprising a transverse path intersecting with a plurality of said paper roll transporting paths for permitting transportation of paper rolls in a direction transverse to the direction of said paper roll transporting paths, said transverse path being located between said paper roll delivery outlets and said paper roll supply stations.

6. A paper roll supply system as set forth in claim 5, wherein each of said paper roll transporting means includes an orienting means for orienting paper rolls into a desired orientation, at least one of said orienting means being positioned at an intersection of one of said paper roll transporting paths with said transverse path.

7. A paper roll supply system as set forth in claim 6, wherein said orienting means comprises a turntable provided in one of said paper roll transporting paths.

8. A paper roll supply system as set forth in claim 3, wherein said paper roll transporting means includes an orienting means for orienting said paper rolls into a desired orientation.

9. A paper roll supply system as set forth in claim 8, wherein said orienting means comprises a turntable provided in said paper roll transporting path.

10. A paper roll supply system for a rotary press system having first and second rotary presses, comprising:

a plurality of paper roll supply stations for selectively transferring paper rolls to a plurality of feeder stations which respectively feed paper rolls to a plurality of rotary presses, each of said paper roll supply stations being exclusively associated with a predetermined pair of adjacent feeder stations;

a paper roll storage consisting of a single spatial paper roll storage, said spatial paper roll storage comprising:

at least one paper roll storage portion having a plurality of vertically arranged shelves for storing a plurality of paper rolls in desired orientation;

a first paper roll pick-up mechanism associated with said at least one paper roll storage portion, said first paper roll pick-up mechanism having a respective paper roll delivery outlet aligned with a first paper roll supply station for supplying paper rolls to a feeder station associated with said first rotary press along a substantially straight first paper roll transporting path; and a second paper roll pick-up mechanism associated with said at least one paper roll storage portion said second paper roll pick-up mechanism having a respective paper roll delivery outlet positioned in spaced apart parallel relationship with said first paper roll delivery outlet and aligned with a second paper roll supply station positioned in a spaced parallel relationship with said first paper roll supply station for supplying paper rolls to a feeder station associated with said second rotary press along a substantially straight second paper roll transporting path extending in a spaced parallel relationship with said first paper roll supply path;

a first paper roll transporting means disposed between said first paper roll delivery outlet and said first paper roll supply station for transporting a paper roll along said first paper roll transporting path; and a second paper roll transporting means disposed between said second paper roll delivery outlet and said second paper roll supply station for transporting a paper roll along said second paper roll transporting path.

11. A paper roll supply system as set forth in claim 10, wherein each of said first and second paper roll transporting means includes an orienting means for orienting paper rolls into a desired orientation.

12. A paper roll supply system as set forth in claim 11, wherein said orienting means comprises a turntable provided in at least one of said paper roll transporting paths.

13. A paper roll supply system as set forth in claim 10, further comprising a transverse path intersecting with said first and second paper roll transporting paths for permitting transportation of paper rolls in a direction transverse to the direction of said first and second paper roll transporting paths said transverse path being located between said paper roll delivery outlets and said paper roll supply stations.

14. A paper roll supply system as set forth in claim 13, wherein each of said first and second paper roll transporting means includes an orienting means for orienting paper rolls into a desired orientation, said orienting means being positioned at an intersection of said paper roll transporting paths with said transverse path.

15. A paper roll supply system as set forth in claim 14, wherein said orienting means comprises a turntable provided in at least one of said paper roll transporting paths.

* * * * *